US009772600B2

(12) United States Patent
Morioka et al.

(10) Patent No.: US 9,772,600 B2
(45) Date of Patent: Sep. 26, 2017

(54) SIDE MEMBER, CARTRIDGE, AND IMAGE FORMING APPARATUS

(71) Applicant: CANON KABUSHIKI KAISHA, Tokyo (JP)

(72) Inventors: Masanari Morioka, Yokohama (JP); Yuichi Fukui, Yokosuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/052,545

(22) Filed: Feb. 24, 2016

(65) Prior Publication Data

US 2016/0252879 A1 Sep. 1, 2016

(30) Foreign Application Priority Data

Feb. 27, 2015 (JP) ..... 2015-037866

(51) Int. Cl.
*G03G 21/18* (2006.01)
*G03G 21/16* (2006.01)

(52) U.S. Cl.
CPC ..... *G03G 21/1803* (2013.01); *G03G 21/1814* (2013.01); *G03G 21/1885* (2013.01); *G03G 21/1647* (2013.01); *G03G 21/1652* (2013.01); *G03G 21/1857* (2013.01); *G03G 21/1867* (2013.01); *G03G 2221/1823* (2013.01)

(58) Field of Classification Search
CPC ..... G03G 21/1803; G03G 21/1817; G03G 21/1839; G03G 21/1875; G03G 21/1878; G03G 2221/18; G03G 2221/1823; G03G 2221/183; G03G 2221/1853; G03G 2221/1869; G03G 21/1814; G03G 21/1857; G03G 21/1867; G03G 21/1885; G03G 21/1647; G03G 21/1652
USPC ..... 399/111, 113
See application file for complete search history.

(56) References Cited

U.S. PATENT DOCUMENTS

| | | | | |
|---|---|---|---|---|
| 8,849,133 | B2 * | 9/2014 | Itabashi | G03G 21/1875 399/111 |
| 2008/0159772 | A1 | 7/2008 | Koishi | |
| 2008/0159773 | A1 * | 7/2008 | Murayama | G03G 21/1867 399/111 X |
| 2008/0159774 | A1 * | 7/2008 | Tanabe | G03G 21/1842 399/111 X |
| 2009/0245857 | A1 | 10/2009 | Tanabe | |
| 2011/0311265 | A1 | 12/2011 | Ueno | |
| 2013/0251402 | A1 * | 9/2013 | Yamashita | G03G 21/18 399/111 |

(Continued)

FOREIGN PATENT DOCUMENTS

| | | | |
|---|---|---|---|
| JP | 2007-121983 | A | 5/2007 |
| JP | 2014-145793 | A | 8/2014 |

*Primary Examiner* — Sophia S Chen
(74) *Attorney, Agent, or Firm* — Canon USA, Inc. I.P. Division

(57) ABSTRACT

A nondrive-side side member forms a part of a cartridge and includes a frame portion, and a regulation frame portion provided in the frame portion, to regulate movement of the cartridge. The frame portion has a hole provided to expose an electric contact. Further, a drive-side side member forms a part of a cartridge and includes a frame portion having a first hole and a second hole with a diameter larger than a diameter of the first hole, and a slit portion into which a memory for storing information is to be inserted.

35 Claims, 8 Drawing Sheets

(56) References Cited

U.S. PATENT DOCUMENTS

| | | | | |
|---|---|---|---|---|
| 2013/0315618 | A1 | 11/2013 | Koishi | |
| 2015/0055963 | A1 * | 2/2015 | Kanno | G03G 21/1878 399/111 X |

* cited by examiner

SIDE MEMBER, CARTRIDGE, AND IMAGE FORMING APPARATUS

BACKGROUND OF THE INVENTION

Field of the Invention

The present invention relates to a side member, a cartridge, and an image forming apparatus. The image forming apparatus forms an image on a recording medium, by using an image forming process employing, for example, an electrophotographic image forming system, an electrostatic recording image forming system, a magnetic recording image forming system, or the like. Examples of the image forming apparatus include a copying machine, a printer (such as a laser beam printer and a light emitting diode (LED) printer), a facsimile machine, a multifunction peripheral having these functions, and a word processor.

The recording medium is a medium on which an image is to be formed by the image forming apparatus. Examples of the recording medium include a sheet of paper and an overhead transparency sheet. The examples also include an intermediate transfer member, and an image display member of an image display apparatus.

Description of the Related Art

For example, an electrophotographic image forming apparatus, such as a printer using an electrophotographic process, uniformly charges an electrophotographic photosensitive member serving as an image bearing member, and selectively exposes the electrophotographic photosensitive member to light. As a result, a latent image is formed. The latent image is then developed with a developer, to appear as a developer image. The developer image is then transferred to a recording medium. The developer image transferred to the recording medium is fixed by application of heat and pressure. An image is thus recorded.

For forming a color image in the electrophotographic image forming apparatus, one method is widely known. In this method, developer images (hereinafter referred to as "toner images") formed with, for example, yellow, magenta, cyan, and black developers (hereinafter referred to as "toner") are superimposed on one another.

Meanwhile, a cartridge system is widely adopted. In the cartridge system, a developer containing portion (a toner containing portion) containing toner and developing members such as a developing roller are incorporated into a frame, thereby forming a unit (a developing cartridge). In the cartridge system, the toner or the developing roller can be easily replaced, when reaching a predetermined lifetime.

A tandem-type color laser printer is known as an electrophotographic-type image forming apparatus. Japanese Patent Application Laid-Open No. 2007-121983 discusses an apparatus including image forming units provided in a main body casing. The image forming units are each configured of components such as a photosensitive drum, a developing portion, and a charging device. The image forming units are accommodated in a developing-cartridge accommodation tray portion shaped like a box. A user can replace the developing portion (a developing cartridge) of each of the image forming units, in a state where the tray portion (a drawer) is drawn frontward from the main body casing (an image forming apparatus main body).

In recent years, color-electrophotographic-type image forming apparatuses have been widespread, and user needs have become various. Among others, a reduction in size is expected, since the number of cases where an image forming apparatus is set on a desk and used is increasing. As the size of an apparatus main body is reduced, space for mounting a developing cartridge and a process cartridge is also reduced. Therefore, it is expected to provide a cartridge and an image forming apparatus that are small in the number of components, small in size, and low at a cost, by incorporating functions into one component, even if the space is limited.

SUMMARY OF THE INVENTION

The present invention is directed to providing a side member, a cartridge, and an image forming apparatus, which are capable of incorporating functions into one component, thereby decreasing the number of components.

According to an aspect of the present invention, a side member forms a part of a cartridge to be used for forming an image on a recording medium, and the side member includes a frame portion, and a regulation groove portion provided in the frame portion, to regulate movement of the cartridge, wherein the frame portion has a hole provided to expose an electric contact, and wherein, when the cartridge is mounted to a main body of an image forming apparatus, the regulation groove portion and the hole are located on a straight line in a direction of mounting the cartridge.

According to another aspect of the present invention, a side member forms a part of a cartridge to be used for forming an image on a recording medium, and the side member includes a frame portion having a first hole and a second hole with a diameter larger than a diameter of the first hole, and a slit portion into which a memory for storing information is to be inserted.

According to yet another aspect of the present invention, an image forming apparatus and a cartridge each include the side member.

Further features of the present invention will become apparent from the following description of exemplary embodiments with reference to the attached drawings.

DESCRIPTION OF THE EMBODIMENTS

Preferable exemplary embodiments of the present invention will be described in detail below, based on the attached drawings.

(Image Forming Apparatus and Process Cartridge)

First, an image forming apparatus 1 and a process cartridge P according to an exemplary embodiment will be described using a cross-sectional schematic diagram of each of FIGS. 2 and 3. The image forming apparatus 1 is a full-color laser printer using four colors, which employs an electrophotographic process. The image forming apparatus 1 forms a color image on a recording medium S, based on image information (an electrical image signal) input into a control circuit unit (a control device, or a control unit) 100, from an external host apparatus 300 illustrated in FIG. 2. The external host apparatus 300 is a personal computer, an image reader, a facsimile, a network, or the like.

The image forming apparatus 1 employs a cartridge system, in which an image is formed on a recording medium, in a state where a process cartridge that contributes to an image forming process is removably mounted. The image forming apparatus 1 of the present exemplary embodiment forms a color image on the recording medium S, in a state where four process cartridges P (PY, PM, PC, and PK) are removably mounted in an apparatus main body 2.

Figure 2:
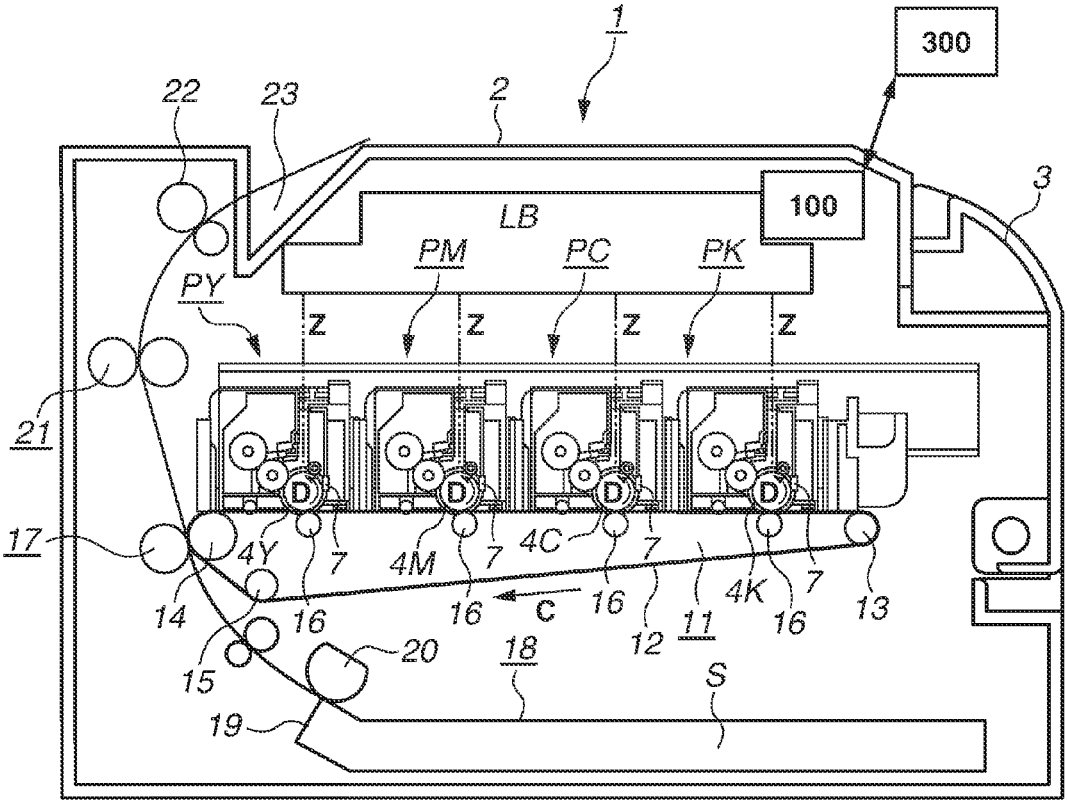
FIG. 2 is a cross-sectional schematic diagram of an image forming apparatus according to the exemplary embodiment of the present invention.

The first process cartridge PY illustrated in FIG. 2 contains yellow (Y) toner in a developer containing chamber 26*c*, and forms a Y-color toner image on a surface of a photosensitive drum 4. The second process cartridge PM contains magenta (M) toner in a developer containing chamber 26*c*, and forms an M-color toner image on a surface of a photosensitive drum 4. The third process cartridge PC contains cyan (C) toner in a developer containing chamber 26*c*, and forms a C-color toner image on a surface of a photosensitive drum 4.

Further, the fourth process cartridge PK contains black (K) toner in a developer containing chamber 26*c*, and forms a K-color toner image on a surface of a photosensitive drum 4.

The process cartridge may include at least an image bearing member. As will be described in detail below, the process cartridge of the present exemplary embodiment includes an image bearing unit (a photosensitive unit), a development unit, and a cover member (a side member) on each of a drive side and a nondrive side to connect these units.

Here, as for the image forming apparatus 1, a face where an apparatus open/close door 3 is provided is assumed to be the front (a front face), whereas a face opposite to the front is assumed to be the back (a rear face). Further, when the image forming apparatus 1 is viewed from the front, the right side is assumed to be a drive side, whereas the left side is assumed to be a nondrive side.

Figure 3:
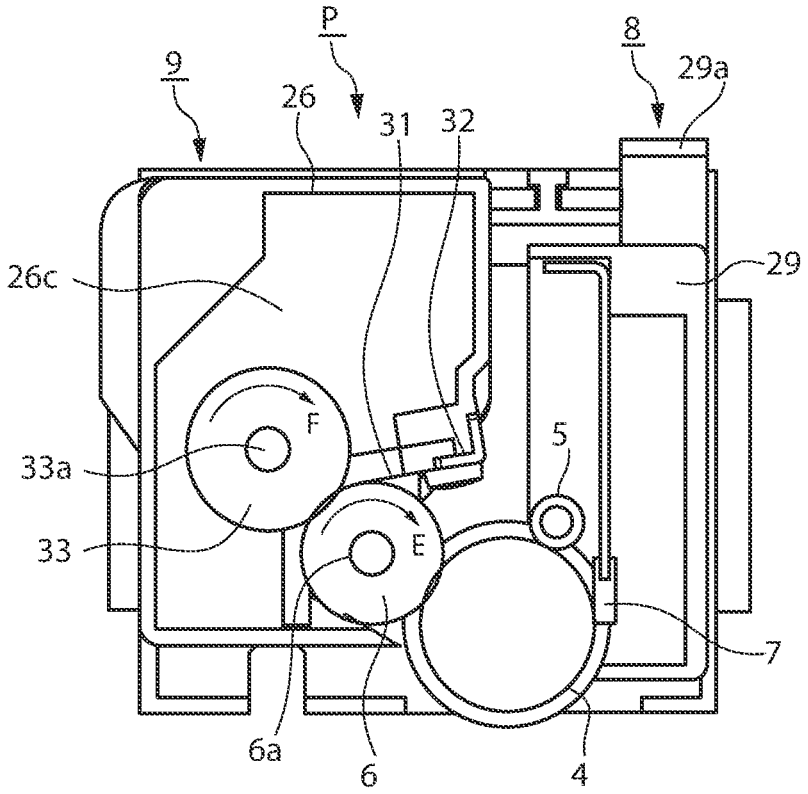
FIG. 3 is a cross-sectional schematic diagram of the process cartridge according to the exemplary embodiment of the present invention.

In FIGS. 2 and 3, above a photosensitive unit 8 (including the photosensitive drum 4 serving as the image bearing member, a charging roller 5, and a cleaning member 7), a laser scanner unit LB is provided to serve as an exposure device. The laser scanner unit LB outputs a laser beam Z according to image information. The laser beam Z performs scanning exposure on the surface of the photosensitive drum 4, by passing through inside of the process cartridge P.

Further, a development unit 9 is provided beside the photosensitive unit 8. Below the photosensitive drum 4, an intermediate transfer belt unit 11 serving as a transfer member is provided. The intermediate transfer belt unit 11 has a drive roller 13, a turn roller 14, and a tension roller 15. A transfer belt 12, which is a flexible endless belt, is looped over these rollers.

The photosensitive drum 4 has a lower surface being in contact with an upper surface of the transfer belt 12. This contact part is a primary transfer part. Inside the transfer belt 12, a primary transfer roller 16 is provided to face the photosensitive drum 4. A secondary transfer roller 17 is provided to be in contact with the turn roller 14, with the transfer belt 12 interposed therebetween. A contact part between the transfer belt 12 and the secondary transfer roller 17 is a secondary transfer part.

Below the intermediate transfer belt unit 11, a feed unit 18 is provided. The feed unit 18 has a paper feed tray 19 and a paper feeding roller 20. The paper feed tray 19 contains the stacked recording media S. At an upper left part (an upper part on the back side) in inside of the apparatus main body 2 in FIG. 2, a fixing unit 21 and a discharge unit 22 are provided. A top surface of the apparatus main body 2 serves as a discharge tray 23. An unfixed toner image is fixed by a fixing device provided in the fixing unit 21, so that a fixed image is formed on the recording medium S. The recording medium S is then discharged to the discharge tray 23, as an object where an image is formed. A recording medium conveying path from the feed unit 18 to the discharge unit 22 is a conveying unit for conveying a recording medium.

(Image Forming Operation)

Operation for forming a full-color image is performed as follows. The photosensitive drum 4 is driven to rotate (in an arrow D direction in FIG. 2) at a predetermined speed. The transfer belt 12 is also driven to rotate forward with respect to the rotation of the photosensitive drum 4 (i.e., in an arrow C direction in FIG. 2), at a speed corresponding to the speed of the photosensitive drum 4. The laser scanner unit LB is also driven.

In synchronization with the driving of the laser scanner unit LB, the charging roller 5 uniformly charges the surface of the photosensitive drum 4 to provide predetermined polarity and potential, in each of the photosensitive units 8 illustrated in FIG. 3. The laser scanner unit LB performs scanning exposure on the surface of each of the photosensitive drums 4 with the laser beam Z, according to an image signal of the corresponding color. An electrostatic latent image according to the image signal of the corresponding color is thereby formed on the surface of each of the photosensitive drums 4. The electrostatic latent image is then developed to be a toner image, by a developing roller 6, which is driven to rotate (in an arrow E direction in FIG. 3) at a predetermined speed, of the process cartridge P.

By the above-described electrophotographic image forming process operation, a Y-color toner image corresponding to a Y-color component of a full-color image is formed on the photosensitive drum 4 of the first photosensitive unit 8 (8Y). The Y-color toner image is then primarily transferred onto the transfer belt 12. On the photosensitive drum 4 of the second photosensitive unit (8M), an M-color toner image corresponding to an M-color component of the full-color image is formed. The M-color toner image is then primarily transferred to be superimposed on the Y-color toner image already transferred onto the transfer belt 12.

Further, a C-color toner image corresponding to a C-color component of the full-color image is formed on the photosensitive drum 4 of the third photosensitive unit 8 (8C). The C-color toner image is then primarily transferred to be superimposed on the Y-color toner image and the M-color toner image already transferred onto the transfer belt 12. On the photosensitive drum 4 of the fourth photosensitive unit 8 (8K), a K-color toner image corresponding to a K-color component of the full-color image is formed. The K-color toner image then primarily transferred to be superimposed on the Y-color toner image, the M-color toner image, and the C-color toner image already transferred onto the transfer belt 12. In this way, a full-color unfixed toner image, which is formed of superimposed transfer toner images of four colors of the Y color, the M color, the C color, and the K color, is formed on the transfer belt 12.

Meanwhile, the recording media S are separated and fed one by one from the feed unit 18 in a predetermined control timing. The recording medium S is guided into the secondary transfer part, which is the contact part between the secondary transfer roller 17 and the transfer belt 12, in a predetermined control timing. Therefore, in a process of pinching and conveying the recording medium S at the secondary transfer part, the superimposed toner images of four colors on the surface of the transfer belt 12 are secondarily transferred to the surface of the recording medium S, collectively. The recording medium S, to which the toner images have been secondarily transferred, is guided into the fixing unit 21 thereby being subjected to a fixing process. The recording medium S is then discharged to the discharge tray 23, as an object where a full-color image is formed.

(Specific Configuration of Process Cartridge)

Figure 1A:
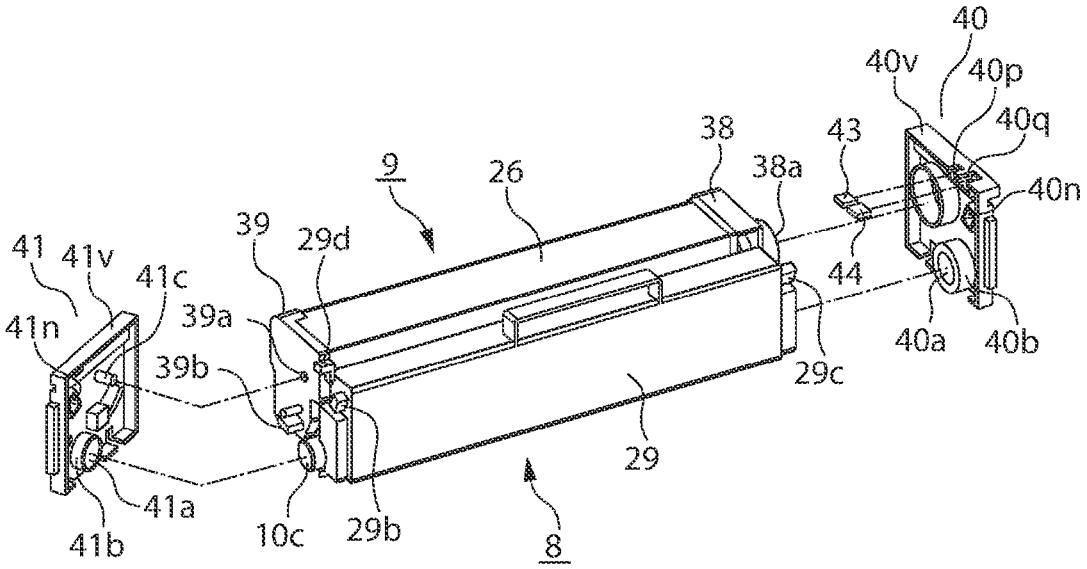
FIGS. 1A and 1B are an assembly perspective view and a side view, respectively, of a process cartridge according to an exemplary embodiment of the present invention.
Figure 1B:
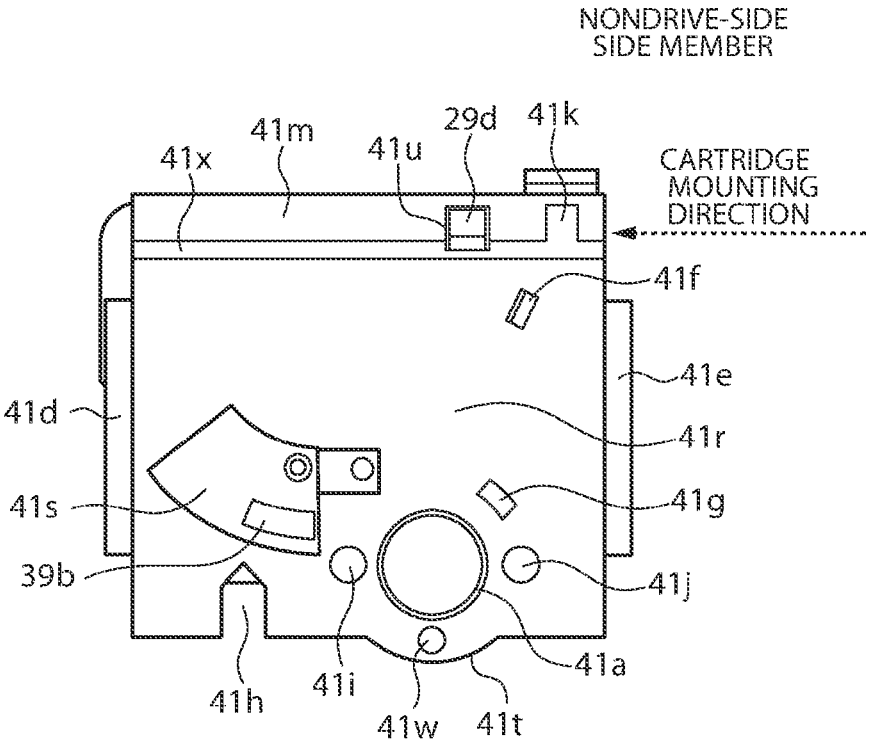
Figure 4A:
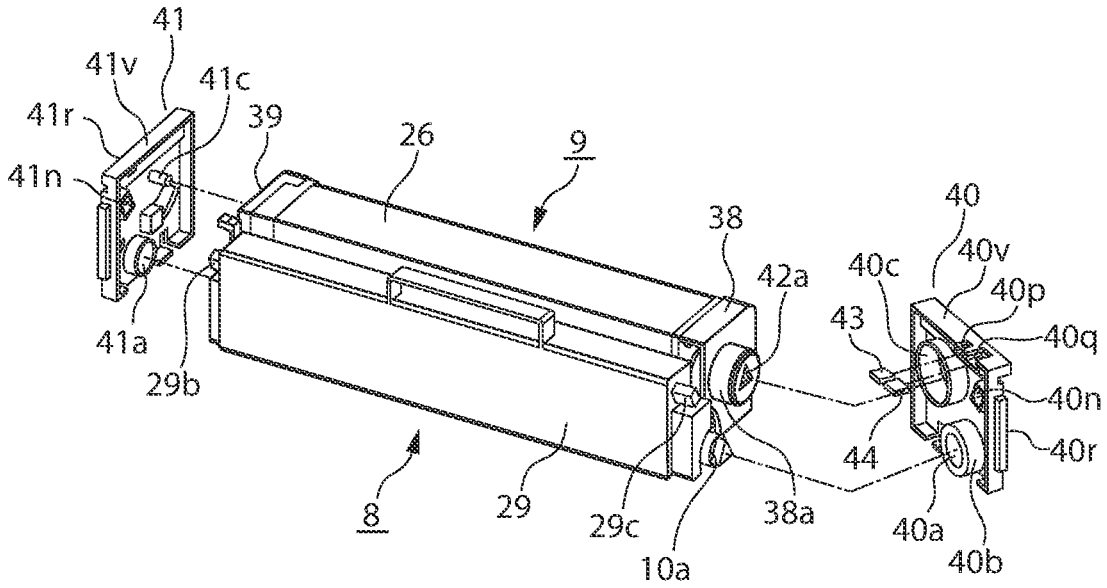
FIGS. 4A and 4B are an external perspective view and a side view, respectively, of the process cartridge when viewed from a drive side, according to the exemplary embodiment of the present invention.
Figure 4B:
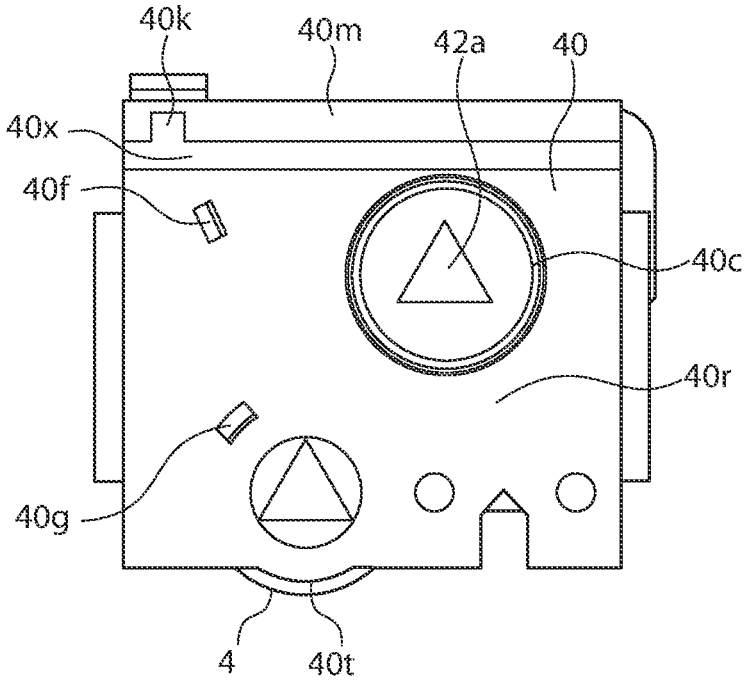

A specific configuration of the process cartridge P, which is capable of being removably mounted to the apparatus main body 2, will be further described using FIGS. 1A and 1B, FIG. 3, as well as FIGS. 4A and 4B. FIGS. 1A and 1B are an assembly perspective view and a side view, respectively, of the process cartridge P when viewed from the nondrive side. FIG. 3 is a cross-sectional diagram of the process cartridge P. FIGS. 4A and 4B are an assembly perspective view and a side view, respectively, of the process cartridge P when viewed from the drive side.

As will be described in detail below, the process cartridge includes an image bearing unit (a photosensitive unit), a development unit, and a cover member (a side member) on each of the drive side and the nondrive side to connect these units.

1) Image Bearing Unit

The image bearing unit (hereinafter referred to as the photosensitive unit 8) includes a drum-type electrophotographic photosensitive member (hereinafter referred to as the photosensitive drum 4), which serves as a rotatable image bearing member where a latent image is to be formed. The photosensitive unit 8 further includes a cleaner case 29 that holds the charging device 5 and the cleaning member 7 each serving as a process device that acts on the photosensitive drum 4.

A charging roller, which is a contact charging member, is used for the charging device 5. The charging roller rotates to follow the photosensitive drum 4, by contacting the surface of the photosensitive drum 4. The charging roller charges the surface of the photosensitive drum 4, by being supplied with a charging bias.

For the cleaning member 7, a cleaning blade is used. The cleaning blade is fixed to the cleaner case 29, and has an elastic rubber part at a leading end. The elastic rubber part is provided to be in contact with the surface of the photosensitive drum 4, while facing in a direction opposite to the rotation direction (the arrow D direction in FIG. 2) of the photosensitive drum 4. The leading end of the cleaning member 7 (hereinafter referred to as the cleaning blade 7) is in contact with the surface of the photosensitive drum 4 with a predetermined pressure, to scrape untransferred toner sufficiently.

In an image-forming period, the cleaning blade 7 scrapes the untransferred toner remaining on the surface of the photosensitive drum 4. The untransferred toner scraped by the cleaning blade 7 is stored into a waste toner containing portion (not illustrated) of the cleaner case 29, as waste toner. Further, a handle 29*a* for holding the process cartridge P at the time of cartridge replacement is integrally provided for the cleaner case 29.

2) Development Unit

As illustrated in FIG. 3, the development unit 9 includes the developing roller 6 (a developer bearing member). The developing roller 6 has an oblong shape with a longitudinal direction being a rotation axial direction, and serves as a developing device. The development unit 9 further includes a developing frame 26, a developing blade 31, a developer feed roller 33, and the like. The development units 9 each have a similar electrophotographic process mechanism, and contain toner of different one of colors.

The developing roller 6 and the developer feed roller 33 each have an axis, and both ends of each axis are rotatably supported by a drive-side bearing 38 and a nondrive-side bearing 39, which are attached to both side faces of the developing frame 26. Further, at a drive-side end of a core (a metal core) 6*a* of the developing roller 6, and a drive-side end of a core (a metal core) 33*a* of the developer feed roller 33, a developing roller gear (not illustrated) and a supply roller gear (not illustrated) are disposed, respectively. These gears engage with a developing drive input gear (not illustrated) having a developing drive coupling 42*a* (FIGS. 4A and 4B).

A driving output coupling (not illustrated) on the apparatus main body 2 side engages with the developing drive coupling 42*a*, thereby transmitting a driving force of a drive motor (not illustrated) of the apparatus main body 2. The developing roller 6 and the developer feed roller 33 are thereby driven to rotate (in the arrow E direction and an arrow F direction in FIG. 3, respectively) at a predetermined speed.

The developing blade 31 is an elastic metal sheet having a thickness of about 0.1 mm, and is a member long in a rotation axial direction of the developing roller 6, as illustrated in FIG. 3. The developing blade 31 is supported by a supporting metal plate 32, and the supporting metal plate 32 is attached to the developing frame 26. The developing blade 31 and the supporting metal plate 32 form a developing blade unit. The developing blade 31 has a free end in a transverse direction, and the free end is in contact with the developing roller 6 to face in a direction opposite to the rotation direction (the arrow E direction in FIG. 3) of the developing roller 6.

In FIG. 3, in the image-forming period, the developer feed roller 33 and the developing roller 6 are driven to rotate so that friction occurs therebetween, and due to this friction, the developing roller 6 bears the toner contained in the developer containing chamber 26*c*. The developing blade 31 regulates the thickness of a toner layer formed on a peripheral surface of the developing roller 6. In addition, the developing blade 31 applies a contact pressure to the developing roller 6, thereby applying an electric charge based on triboelectric charging, to the toner. When the electric charge is applied to the toner, at the contact part between the developing roller 6 and the photosensitive drum 4 the toner on the developing roller 6 adheres to an electrostatic latent image on the photosensitive drum 4, so that the latent image is developed.

3) Cover Member (Side Member)

Here, as illustrated in FIG. 4A, the photosensitive unit 8 and the development unit 9 are coupled to each other by a cover member (a side member) disposed at each of both ends of the photosensitive drum 4 in the rotation axial direction. A drive-side cover member 40 (a drive-side side member) serving as a first end cover member is disposed at the end on the drive side, and a nondrive-side cover member 41 (a nondrive-side side member) serving as a second end cover member is disposed at the end on the nondrive side.

3-1) Drive-Side Side Member

The drive-side cover member 40 includes a frame portion 40*v*. The drive-side cover member 40 further includes a first plane 40*r*, which is a substantially flat surface. The first plane 40*r* is an outer side face that forms an end surface of the process cartridge P. The first plane 40*r* has a first hole portion 40*a* as a first hole, which is a through hole. A drive-side end member 10*a* attached to an end of the photosensitive drum 4 is rotatably supported by an inner periphery side of the first hole portion 40*a*. An outer periphery side of the first hole portion 40*a* forms a cylinder portion 40*b*, which is coaxial with the first hole portion 40*a*. The cylinder portion 40*b* is used as a shape for positioning the cleaner case 29 and the drive-side cover member 40.

The first plane 40*r*, which forms the end surface of the process cartridge P of the drive-side cover member 40, further has a second hole portion 40*c* protruding inward (from an inner surface opposite to the first plane 40*r*). The second hole portion 40*c* serves as a second hole, which is a through hole with a diameter greater than the diameter of the first hole. A supporting cylinder 38*a*, which is provided at an end of the development unit 9, is rotatably supported by an inner periphery of the second hole portion 40*c*.

An outer surrounding part (a thick wall part) in the shape of a box extends from the first plane 40*r* of the drive-side cover member 40. The outer surrounding part has a first slit 40*p* and a second slit 40*q* each serving as a slit portion. At the time of assembly, a memory device (a memory) 43 is inserted into the first slit 40*p*, whereas a color chip 44 serving as a color discrimination member is inserted into the second slit 40*q*.

In the present exemplary embodiment, the memory 43 for storing information has a rectangle shape having a longitudinal direction and a transverse direction, in a plane that intersects a thickness direction. Further, the first slit 40*p*, into which the memory 43 is to be inserted, has an opening shape. The opening shape is long in a first direction (a direction intersecting the thickness direction of the memory 43) and short in a second direction (corresponding to the thickness direction of the memory 43), when viewed from an insertion direction of the memory 43. The memory 43 is inserted into the first slit 40*p*, in the insertion direction parallel with the longitudinal direction. The first direction of the first slit 40*p* is longer than the transverse direction of the memory 43, and shorter than the longitudinal direction of the memory 43.

In this way, the memory device 43 and the color chip 44 being inserted are each held to have a surface exposed on an upper part of the process cartridge P, while being prevented from falling off.

Further, a rectangular hole 40*n* is provided on an attachment surface (an inner side face) side of the drive-side cover member 40, for second positioning with respect to the cleaner case 29. A rectangular pillar 29*c* of the cleaner case 29 is to be engaged in the rectangular hole 40*n*. The drive-side cover member 40 and the cleaner case 29 are thereby positioned relative to each other.

3-2) Nondrive-Side Side Member

As illustrated in FIGS. 1A and 1B, the nondrive-side cover member 41 includes a frame portion 41*v*, and a first hole portion 41*a* is provided in a second plane 41*r* to pass therethrough. The second plane 41*r* is a substantially flat surface, and corresponds to an outer side face forming an end surface of the process cartridge P. The first hole portion 41*a* serves as a first supporting portion that supports the photosensitive drum 4 (the image bearing member). A nondrive-side end member 10*c*, which is attached to an end of the photosensitive drum 4, is rotatably supported by an inner periphery side of the first hole portion 41*a*. Further, a cylinder portion 41*b* serving as an outer periphery side of the first hole portion 41*a* is formed on a side face (an inner side face) opposite to the second plane 41*r*. The cylinder portion 41*b* is used as a shape for positioning the cleaner case 29 and the nondrive-side cover member 41.

Further, a rectangular hole 41*n* is provided on an attachment surface (an inner side face) side of the nondrive-side cover member 41, for the second positioning with respect to the cleaner case 29. A rectangular pillar 29*b* of the cleaner case 29 is to be engaged in the rectangular hole 41*n*. The nondrive-side cover member 41 and the cleaner case 29 are thereby positioned relative to each other. Furthermore, a second protrusion 41*c* is provided on the side face (the inner side face) opposite to the second plane 41*r* of the nondrive-side cover member 41. The second protrusion 41*c* serves as a second supporting portion that supports the developing roller 6 (the developer bearing member). A supporting hole 39*a* provided at the end of the development unit 9 is rotatably supported by an outer periphery of the second protrusion 41*c*.

Further, an opening portion 41*s* is provided in the second plane 41*r* of the nondrive-side cover member 41. The opening portion 41*s* allows an electric contact 39*b* of the development unit 9 to pass therethrough. The electric contact 39*b* on the nondrive side is thereby exposed to the outside, at the time of assembly. In inside of the development unit 9, a circuit is connected to the developing roller 6, and the electric contact 39*b* is provided to generate a predetermined potential difference by receiving a voltage input from the apparatus main body 2.

Similarly, a second hole portion 41*u* is formed to expose an electric contact 29*d*, which is provided at the cleaner case 29, to the outside. In inside of the process cartridge P, a circuit is connected to the charging roller 5, and the electric contact 29*d* is provided to generate a predetermined potential difference by receiving a voltage input from the apparatus main body 2.

Figure 7A:
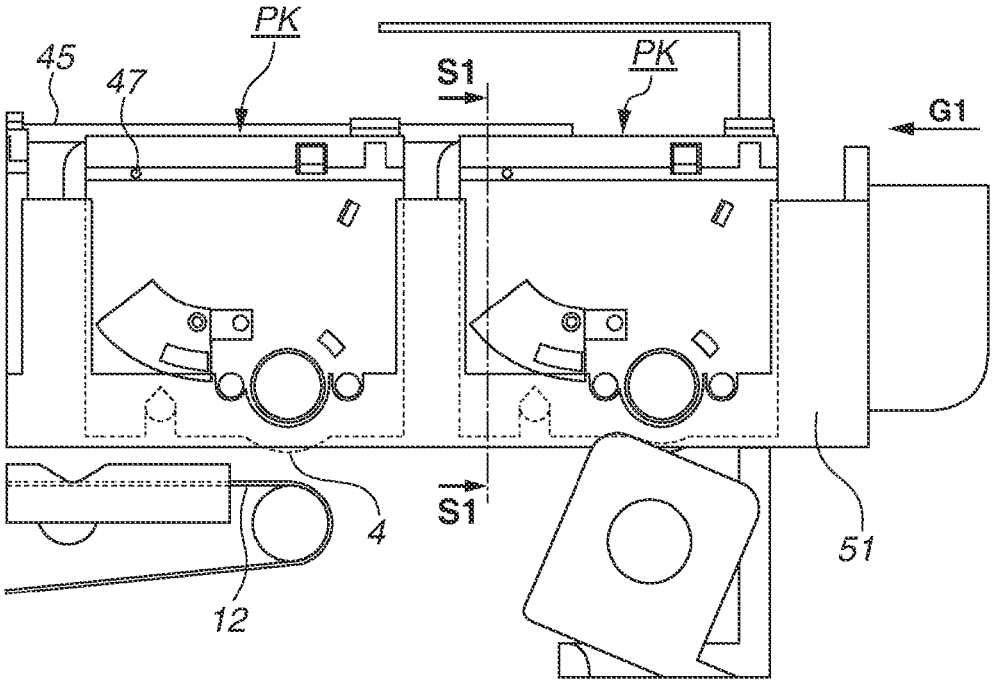
FIGS. 7A and 7B are cross-sectional conceptual diagrams of the drawer unit being sent to a main body, according to the exemplary embodiment of the present invention.
Figure 7B:
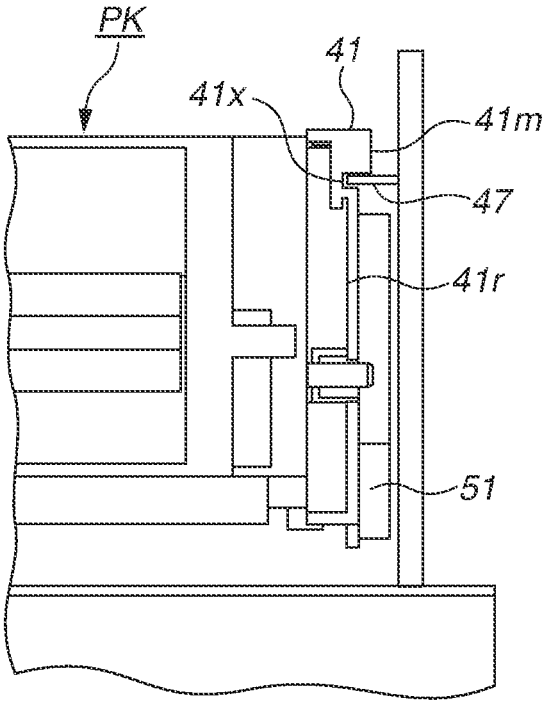

Here, as illustrated in FIG. 1B, a third groove portion 41*x* in the shape of a groove is provided for cartridge mounting. The third groove portion 41*x* extends, in a cartridge carrying-in/out direction (a direction intersecting a cartridge longitudinal direction), in the second plane 41*r* serving as the outer side face of the nondrive-side cover member 41. A rotation stopping protrusion 47 illustrated in FIGS. 7A and 7B is provided in the apparatus main body 2 of the image forming apparatus 1, and enters the third groove portion 41*x* to be engaged therein. The third groove portion 41*x* is formed to be parallel with a direction of mounting a tray unit 51, thereby hitting no other parts in a mounting process.

Further, when viewed from the direction of mounting the tray unit 51, the second hole portion 41*u* is located at a position overlapping a second groove portion 41*k* serving as a regulation groove portion, as illustrated in FIG. 1B. In other words, the second groove portion 41*k* serving as the regulation groove portion, and the second hole portion 41*u* serving as the hole, are located on a straight line in a cartridge mounting direction, when the process cartridge P is mounted to the apparatus main body 2 of the image forming apparatus 1. Therefore, by a descent of the process cartridge P to be described below, a voltage output portion (not illustrated) in the apparatus main body 2 of the image forming apparatus 1 and the electric contact 29*d* are connected, and the rotation stopping protrusion 47 is inserted into the second groove portion 41*k*.

The photosensitive unit 8 and the development unit 9 are connected by the drive-side cover member 40 and the nondrive-side cover member 41 described above. Further, the development unit 9 is swingably supported by the drive-side cover member 40 and the nondrive-side cover member 41. Furthermore, the drive-side cover member 40 and the nondrive-side cover member 41 are fixed to the cleaner case 29, not to fall off.

Specifically, a fixing agent such as an adhesive and a solvent is injected into a contact part between the drive-side cover member 40 and the cleaner case 29, thereby fixing the drive-side cover member 40 and the cleaner case 29. The fixing agent is injected from a first fixing agent inlet 40*f* and a second fixing agent inlet 40*g* provided in the side face of the drive-side cover member 40 illustrated in FIG. 4B. The nondrive-side cover member 41 is fixed by injecting a fixing agent such as an adhesive and a solvent into a contact part between the nondrive-side cover member 41 and the cleaner case 29. The fixing agent is injected from a first fixing agent inlet 41*f* and a second fixing agent inlet 41*g* provided in the side face of the nondrive-side cover member 41 illustrated in FIG. 1B.

(Configuration of Drawer Unit 51 for Mounting and Demounting Process Cartridge P)

Figure 5:
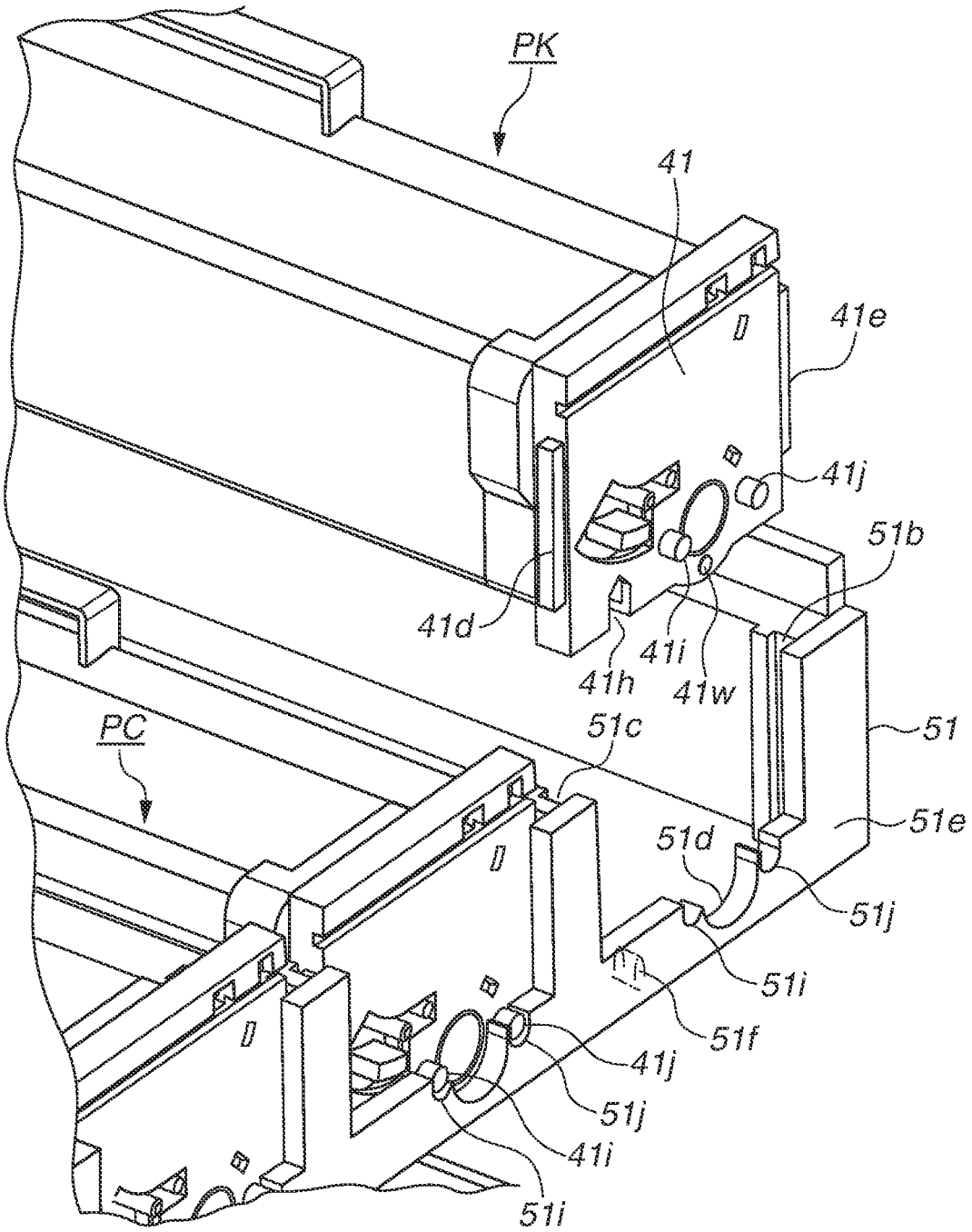
FIG. 5 is an external perspective view of a drawer unit when viewed from a nondrive side during mounting, according to the exemplary embodiment of the present invention.
Figure 6:
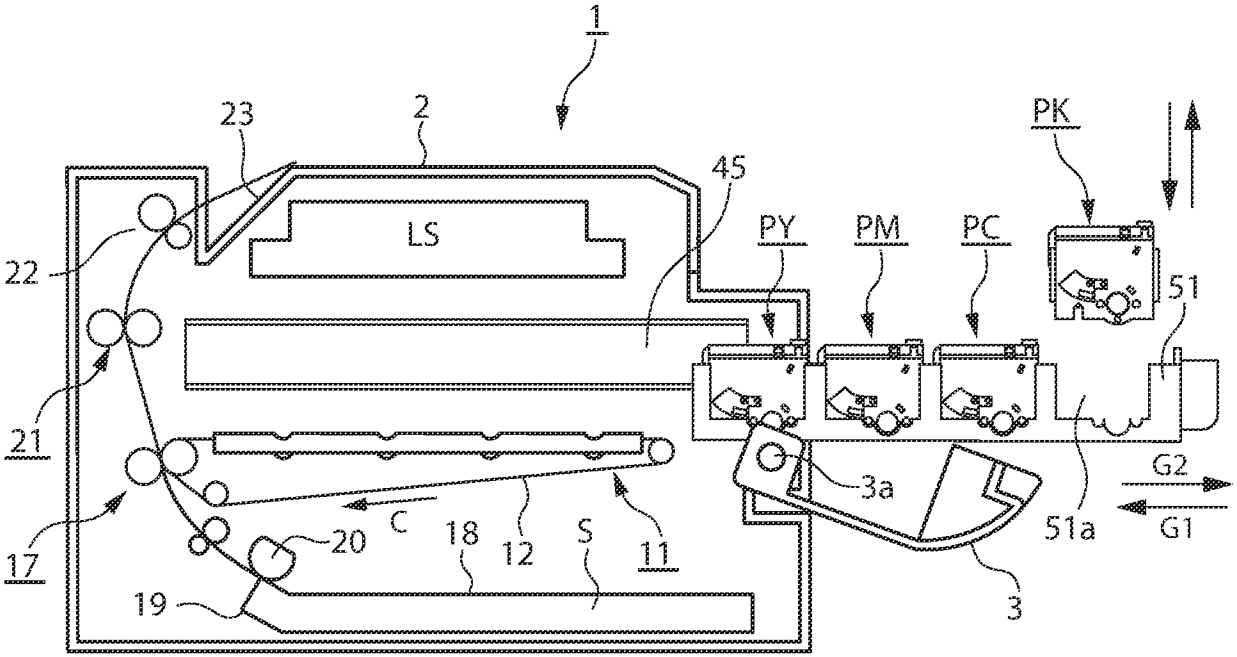
FIG. 6 is a cross-sectional conceptual diagram of the drawer unit being drawn out, according to the exemplary embodiment of the present invention.

Next, operation for mounting and demounting each of the process cartridges P (PY, PM, PC, and PK) to and from the tray unit 51 (hereinafter may be referred to as "drawer unit 51") will be described using FIGS. 5 and 6. FIG. 5 is a perspective view of a cartridge mounting portion of the drawer unit 51. FIG. 6 is a diagram illustrating a state where the drawer unit 51 is drawn out from the apparatus main body 2 of the image forming apparatus 1.

As illustrated in FIG. 6, the process cartridges P are aligned in a moving direction of the drawer unit 51, so that a longitudinal direction (the axial direction of the photosensitive drum 4) of each of the process cartridges P intersects the moving direction of the drawer unit 51. In the drawer unit 51, four cartridge mounting portions 51*a* (51*a*Y, 51*a*M, 51*a*C, and 51*a*K) for attaching the four process cartridges P (PY, PM, PC, and PK), respectively, are arranged in a line.

The four cartridge mounting portions 51*a* (51*a*Y, 51*a*M, 51*a*C, and 51*a*K) all have a similar configuration. Therefore, the fourth cartridge mounting portion 51*a*K (hereinafter referred to as the cartridge mounting portion 51*a*) for mounting the fourth process cartridge PK will be described below as a representative.

In a side face 51*e* of the drawer unit 51, notch portions 51*i* and 51*j* are provided. Further, key grooves 51*b* and 51*c* are provided near an end part of the cartridge mounting portion 51*a* in a longitudinal direction. When a user mounts the process cartridge P, a second projection 41*d* and a third projection 41*e* for cartridge mounting, which are provided on the nondrive-side cover member 41 as illustrated in FIG. 5, advance along the key grooves 51*c* and 51*b*, respectively, of the tray unit 51. When a first groove 41*h* abuts on a supporting protrusion 51*f* provided on an inner wall side of the tray unit 51, mounting to the tray unit 51 is completed.

At this moment, a third protrusion 41*i* and a fourth protrusion 41*j* of the nondrive-side cover member 41 are fitted in the notch portions 51*i* and 51*j*, respectively, of the tray unit 51. Therefore, there is no interference with the tray unit 51.

There may be a case where the user attempts to mount a process cartridge being out of the specification of the apparatus main body 2, due to a similar shape thereof, which is inappropriate. Here, a way of preventing such inappropriate mounting will be described. The positions of the key grooves 51*b* and 51*c* of the tray unit 51 illustrated in FIG. 5 are combined with the positions of the second projection 41*d* and the third projection 41*e* of the nondrive-side cover member 41 illustrated in FIG. 5, in a manner that varies depending on each specification. In this configuration, when the user attempts to mount the process cartridge P of a specification different from an appropriate specification, the second projection 41*d* or the third projection 41*e* interferes with a part other than the key grooves 51*b* and 51*c*. Therefore, none of inappropriate process cartridges can be mounted.

The third protrusion 41*i* and the fourth protrusion 41*j* of the nondrive-side cover member 41 can also have the respective positions varying depending each specification. When the user attempts to mount the inappropriate process cartridge P, the third protrusion 41*i* or the fourth protrusion 41*j* interferes with a part other than the notch portions 51*i* and 51*j* of the tray unit 51, so that mounting is not allowed. A similar way of preventing inappropriate mounting by the user is applied to the relationship between the drive-side cover member 40 and the tray unit 51, and therefore, description thereof will be omitted.

(Configuration of Mounting and Demounting Process Cartridge P to and from Apparatus Main Body 2)

Next, operation of mounting and demounting each of the process cartridges P (PY, PM, PC, and PK) to and from the apparatus main body 2 will be described using FIG. 2, as well as FIG. 6 to FIG. 8. For the apparatus main body 2 in the present exemplary embodiment, replacement of a front access type is employed. Specifically, for replacement, the user mounts or demounts each of the process cartridges P (PY, PM, PC, and PK) to and from the drawer unit 51, at the front of the apparatus main body 2. The drawer unit 51 is configured to be capable of linearly moving (being pushed in/drawn out) between a drawn-out position (FIG. 6) and a mounted position. At the drawn-out position, the process cartridge P can be mounted and demounted with respect to a rail member 45 (see FIG. 6), outside the apparatus main body 2. At the mounted position, the process cartridge P is mounted in the apparatus main body 2.

FIG. 2 illustrates a state where the drawer unit 51 is moved to the mounted position at which each of the process cartridges P is mounted in the apparatus main body 2, and the apparatus open/close door 3 is closed. FIG. 6 illustrates a state where the apparatus open/close door 3 is opened, and the drawer unit 51 is moved to the drawn-out position at which each of the process cartridges P can be mounted and demounted outside the apparatus main body 2. An arrow G2 indicates a drawing-out moving direction of the drawer unit 51, and an arrow G1 indicates a pushing-in moving direction of the drawer unit 51. The drawing-out moving direction indicated by the arrow G2 and the pushing-in moving direction indicated by the arrow G1 of the drawer unit 51 are substantially horizontal.

Here, the drive side and the nondrive side are similar in terms of configuration for mounting the process cartridge P to the apparatus main body 2. Therefore, only operation on the nondrive side will be described. In addition, the process cartridges P (PY, PM, PC, and PK) have a similar configuration, and therefore, operation of only one process cartridge P when viewed from the nondrive-side will be described.

The tray unit 51 on which each of the process cartridges P (PY, PM, PC, and PK) is mounted is pushed by the user in the direction indicated by the arrow G1, into the apparatus main body 2 of the image forming apparatus 1. The tray unit 51 is supported by the rail member 45. FIG. 7A is a cross-sectional diagram of the tray unit 51 being sent into the apparatus main body 2 of the image forming apparatus 1. The process cartridge P supported by the tray unit 51 is set at a height not to be in contact with the surface of the transfer belt 12. FIG. 7B illustrates a cross-sectional diagram taken along a line S1-S1 in FIG. 7A.

The rotation stopping protrusion 47 (FIG. 7B) provided in the apparatus main body 2 of the image forming apparatus 1 enters the third groove portion 41*x* and then is engaged therein. The third groove portion 41*x* is formed to have the shape of a groove, in the second plane 41*r* serving as the outer side face of the nondrive-side cover member 41 as illustrated in FIG. 1B. Here, the third groove portion 41*x* is formed to be parallel with the direction of mounting the tray unit 51, thereby hitting no other parts in the mounting process.

Further, when viewed from the direction of mounting the tray unit 51, the second hole portion 41*u* is located at the position overlapping the second groove portion 41*k* serving as the regulation groove portion, as illustrated in FIG. 1B. In other words, the second groove portion 41*k* serving as the regulation groove portion, and the second hole portion 41*u* serving as the hole, are located on the straight line in the cartridge mounting direction, when the process cartridge P is mounted to the apparatus main body 2 of the image forming apparatus 1. Therefore, by the descent of the process cartridge P to be described below, the voltage output portion (not illustrated) in the apparatus main body 2 of the image forming apparatus 1 and the electric contact 29*d* are connected, and the rotation stopping protrusion 47 is inserted into the second groove portion 41*k*.

Here, the state illustrated in FIG. 2 is achieved, when the user pushes the tray unit 51 to a final position, and then closes the apparatus open/close door 3 pivoting about a hinge shaft 3*a*. FIG. 8 is a cross-sectional diagram illustrating this state more in detail.

Figure 8:
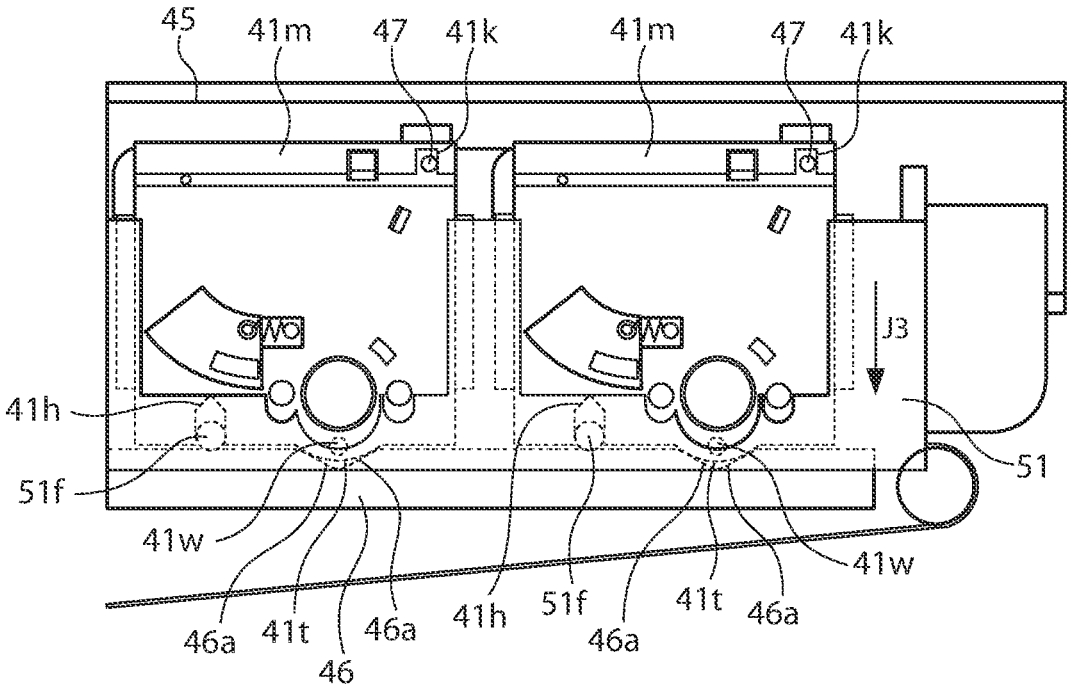
FIG. 8 is a cross-sectional conceptual diagram illustrating the drawer unit descending by interlocking with an open/close door, according to the exemplary embodiment of the present invention.

As illustrated in FIG. 8, the rail member 45 descends (in an arrow J3 direction), by interlocking with the operation of closing the apparatus open/close door 3 by the user. The tray unit 51 descends in the arrow J3 direction as well. A circular arc portion 41*t* of the nondrive-side cover member 41 and a circular arc portion 40*t* (FIG. 4B) of the drive-side cover member 40 come into contact with (abut on) a positioning portion (a positioning portion 46*a* of a positioning member 46) of the apparatus main body 2 of the image forming apparatus 1, while descending. The process cartridge P stops descending, when this contact occurs. Here, the circular arc portion 41*t* of the nondrive-side cover member 41 and the circular arc portion 40*t* of the drive-side cover member 40 each have a circular arc configuration having the same center as a rotation center of the photosensitive drum 4.

The supporting protrusion 51*f* supporting the process cartridge P on the tray unit 51 then leaves the first groove 41*h*. In other words, the process cartridge P is supported in the apparatus main body 2 of the image forming apparatus 1, by the positioning member 46. The rotation stopping protrusion 47 then enters the second groove portion 41*k* (FIG. 1B) vertically extending when viewed from outside in a longitudinal direction of the nondrive-side cover member 41, thereby determining a posture of the process cartridge P.

On the drive-side cover member 40 as well, a rotation stopping protrusion (not illustrated) similar to the rotation stopping protrusion 47 on the nondrive side enters a second groove 40*k*, thereby determining the posture. An amount of engagement (a depth) between the rotation stopping protrusion 47 and the second groove portion 41*k* can be set in a range from the third groove portion 41*x* (40*x*) to a first projection 41*m* (40*m*). Therefore, a sufficient amount of engagement can be achieved. Here, the first projection 41*m* (40*m*) projects further outward than the second plane 41*r*, in a longitudinal direction. The drive-side cover member 40 has a relationship similar to the relationship between the nondrive-side cover member 41 and the tray unit 51, and therefore description thereof will be omitted.

In another movement interlocking with the operation of closing the apparatus open/close door 3 described above, a pressing member (not illustrated) descends from above in a direction of pressing down the process cartridge P. In this process, the process cartridge P is positioned by pressing the drive-side cover member 40. Besides, a contact portion (not illustrated) to be in contact with the memory device 43 is also provided in the apparatus main body 2. Similarly, the nondrive-side cover member 41 receives a downward pressure. Almost simultaneously with this movement, a drive input member (not illustrated), which is a member for driving the photosensitive drum 4 and the developing roller 6 of the process cartridge P to rotate, is connected to the process cartridge P.

Besides being connected to the drive input member, the process cartridge P receives power directed toward the nondrive side, and the nondrive-side cover member 41 is pressed against an inner wall 51*d* of the tray unit 51. A fourth projection 41*w* provided on the nondrive-side cover member 41 abuts on the inner wall 51*d* of the tray unit 51, so that the position in the longitudinal direction is precisely determined (FIGS. 5 and 8).

The process cartridge P mounted in the apparatus main body 2 of the image forming apparatus 1 then performs the above-described image forming operation. The process cartridge P can be demounted in the reverse of the procedure for the mounting operation.

As described above, according to the present exemplary embodiment, the functions are incorporated into the nondrive-side cover member 41 and the drive-side cover member 40. Therefore, a process cartridge and an image forming apparatus, which are small in size and small in the number of components, can be provided at a low cost.

(Modifications)

The preferable exemplary embodiment of the present invention is described above. However, the present invention is not limited to the exemplary embodiment, and may be variously modified within the scope of the gist thereof.

(First Modification)

In the above-described exemplary embodiment, a process cartridge, which has a first unit including an image bearing member and a second unit including a developer bearing member, is described as the cartridge. However, a cartridge, which has a first unit including an image bearing member or a second unit including a developer bearing member, may be adopted. In other words, the present invention is applicable to a cartridge having at least one of a first unit including an image bearing member and a second unit including a developer bearing member.

(Second Modification)

Further, in the above-described exemplary embodiment, a printer is used as one form of the image forming apparatus, but the present invention is not limited thereto. For example, the present invention is applicable to other type of image forming apparatus such as a copying machine and a facsimile machine, and a multifunction peripheral having a combination of these functions.

According to an exemplary embodiment of the present invention, a side member, a cartridge, and an image forming apparatus, which are capable of incorporating functions into one component, thereby decreasing the number of components, can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-037866, filed Feb. 27, 2015, which is hereby incorporated by reference herein in its entirety.

What is claimed is:

1. A side member forming a part of a cartridge to be used for forming an image on a recording medium inside an image forming apparatus, the cartridge having an electric contact, the image forming apparatus having a tray unit, the side member comprising:

a frame portion, wherein the frame portion has a regulation groove portion to regulate movement of the cartridge, wherein the frame portion has a hole to expose the electric contact, wherein the frame portion has another groove portion formed to extend in a direction of inserting the tray unit, and wherein the regulation groove portion and the hole are located on a straight line in the direction of inserting the tray unit.

2. The side member according to claim 1, wherein the frame portion has a first supporting portion for supporting an image bearing member, and a second supporting portion for supporting a developer bearing member.

3. The side member according to claim 2, wherein the side member has a circular arc portion having a same center as a rotation center of the image bearing member, and is configured to abut on a positioning portion of the image forming apparatus.

4. A process cartridge comprising:

an image bearing member; and the side member according to claim 1.

5. An image forming apparatus comprising the process cartridge according to claim 4, and forming an image on a recording medium.

6. The side member according to claim 1, wherein the side member has a first projection projecting further outward than the frame portion to determine a posture of the cartridge.

7. The side member according to claim 1, wherein the another groove portion has the regulation groove portion provided to engage with a rotation stopping member of the image forming apparatus.

8. A side member forming a part of a cartridge, having a development unit and an image bearing member, to be used for forming an image on a recording medium, the side member comprising:

a frame portion having a first through hole and a second through hole with a diameter larger than a diameter of the first through hole; and a slit portion into which a memory for storing information is to be inserted wherein the first through hole can support the development unit and the second through hole can support an end member attached to the image bearing member.

9. The side member according to claim 8, wherein the slit portion has an opening shape, which is long in a first direction and short in a second direction, when viewed from a direction of inserting the memory, wherein the first through hole is provided in the second direction relative to the slit portion, and wherein the second through hole overlaps the first through hole in the first direction.

10. A process cartridge comprising:

an image bearing member; and the side member according to claim 8.

11. An image forming apparatus comprising the process cartridge according to claim 10, and forming an image on a recording medium.

12. The side member according to claim 8, wherein the side member includes another slit portion into which a color discrimination member expressing a color of a developer is to be inserted.

13. The side member according to claim 8, wherein the side member has a circular arc portion having a same center as a rotation center of the image bearing member, and is configured to abut on a positioning portion of the image forming apparatus.

14. The side member according to claim 8, wherein the side member has a first projection projecting further outward than the frame portion to determine a posture of the cartridge.

15. The side member according to claim 8, wherein the side member has a regulation groove portion provided to engage with a rotation stopping member of an image forming apparatus.

16. A cartridge having at least one of a first unit including an image bearing member and a second unit including a developer bearing member, and capable of being removably mounted inside an image forming apparatus, to be used for forming an image on a recording medium, the cartridge comprising:

a drive-side side member; and a nondrive-side side member, wherein the drive-side side member includes a frame portion having a first hole and a second hole with a diameter larger than a diameter of the first hole, and a slit portion into which a memory for storing information is to be inserted, and wherein the nondrive-side side member includes a frame portion having a regulation groove portion to regulate movement of the cartridge and having a hole to expose an electric contact.

17. The cartridge according to claim 16, wherein the drive-side side member includes another slit portion into which a color discrimination member expressing a color of a developer is to be inserted.

18. The cartridge according to claim 16, wherein the drive-side side member and the nondrive-side side member each have a circular arc portion having a same center as a rotation center of the image bearing member, and configured to abut on a positioning portion of the main body of the image forming apparatus.

19. The cartridge according to claim 16, wherein the drive-side side member and the nondrive-side side member each have a first projection projecting further outward than the frame portion to determine a posture of the cartridge.

20. The cartridge according to claim 16, wherein the drive-side side member and the nondrive-side side member each have a groove for cartridge mounting.

21. The cartridge according to claim 16, wherein the drive-side side member and the nondrive-side side member each have a groove portion provided to engage with a rotation stopping member of the main body.

22. The cartridge according to claim 16, wherein the drive-side side member and the nondrive-side side member each have a rectangular hole for positioning relative to the first unit.

23. The cartridge according to claim 16, wherein the drive-side side member and the nondrive-side side member each have a second projection for cartridge mounting, the second projection extending in a direction orthogonal to a longitudinal direction of the cartridge.

24. The cartridge according to claim 23, wherein the drive-side side member and the nondrive-side side member each have a third projection on a side opposite to a side where the second projection is provided, the third projection extending in the direction orthogonal to the longitudinal direction of the cartridge.

25. The cartridge according to claim 24, wherein the nondrive-side side member has a fourth projection for positioning in the longitudinal direction in mounting of the cartridge.

26. The cartridge according to claim 16, wherein the drive-side side member and the nondrive-side side member each have a protrusion extending in a longitudinal direction of the cartridge, to prevent mounting of a different cartridge.

27. The cartridge according to claim 26, wherein the drive-side side member and the nondrive-side side member each have another protrusion extending in the longitudinal direction of the cartridge, together with the protrusion.

28. The cartridge according to claim 16, wherein the drive-side side member has a cylinder portion provided in the frame portion and coaxial with the first hole, for positioning relative to the first unit.

29. The cartridge according to claim 16, wherein the nondrive-side side member has an opening portion that allows an electric contact to pass therethrough.

30. The cartridge according to claim 16, wherein the nondrive-side side member has a protrusion, which is provided in the frame portion, and by which the second unit is rotatably supported.

31. An image forming apparatus comprising the cartridge according to claim 16.

32. The cartridge according to claim 16, wherein the first hole can support a development unit having a developer bearing member and the second hole can support an end member attached to the image bearing member.

33. A side member forming a part of a cartridge to be used for forming an image on a recording medium inside an image forming apparatus, the side member comprising:

a frame portion, wherein the frame portion has a regulation groove portion to regulate movement of the cartridge, wherein the frame portion has a hole to expose an electric contact, wherein the frame portion has another groove portion formed to extend in a predetermined direction, and wherein the regulation groove portion and the hole are located on a straight line in the predetermined direction.

34. A side member forming a part of a cartridge, having a development unit and an image bearing member, to be used for forming an image on a recording medium, the side member comprising:

a frame portion having a first through hole and a second through hole with a diameter larger than a diameter of the first through hole; and a slit portion into which a memory for storing information is to be inserted.

35. The side member according to claim 34, wherein the slit portion has an opening shape, which is long in a first direction and short in a second direction, when viewed from a direction of inserting the memory, wherein the first through hole is provided in the second direction relative to the slit portion.

* * * * *